US007567684B2

(12) United States Patent
Ono et al.

(10) Patent No.: US 7,567,684 B2
(45) Date of Patent: Jul. 28, 2009

(54) SPEAKER DIAPHRAGM AND SPEAKER USING THE SAME

(75) Inventors: Yushi Ono, Neyagawa (JP); Sadatoshi Hisamoto, Neyagawa (JP); Takeru Inoue, Neyagawa (JP)

(73) Assignee: Onkyo Corporation, Neyagawa (JP)

( * ) Notice: Subject to any disclaimer, the term of this patent is extended or adjusted under 35 U.S.C. 154(b) by 755 days.

(21) Appl. No.: 11/183,033

(22) Filed: Jul. 15, 2005

(65) Prior Publication Data

US 2006/0062422 A1 Mar. 23, 2006

(30) Foreign Application Priority Data

Sep. 21, 2004 (JP) ..... 2004-273250

(51) Int. Cl.
*H04R 25/00* (2006.01)

(52) U.S. Cl. ..... 381/424; 381/407; 381/426

(58) Field of Classification Search ..... 381/398, 381/407, 423, 424, 426, 428, 430, 432; 181/163, 181/164, 167, 168, 169
See application file for complete search history.

(56) References Cited

U.S. PATENT DOCUMENTS 4,132,872 A * 1/1979 Inoue ..... 381/424
4,351,411 A * 9/1982 Inoue ..... 181/168
7,274,798 B2 * 9/2007 Ohashi et al. ..... 381/430
2004/0112672 A1 6/2004 Ono et al.

FOREIGN PATENT DOCUMENTS

| | | |
|---|---|---|
| EP | 1 429 582 | 6/2004 |
| JP | 6-34397 | 5/1994 |
| JP | 08-163694 | 6/1996 |
| JP | 8-163694 | 6/1996 |
| JP | 2002-125290 | 4/2002 |
| JP | 2003-153386 | 5/2003 |
| JP | 2003-199193 | 7/2003 |
| JP | 2005-026920 | 1/2005 |
| JP | 2005-26920 | 1/2005 |

* cited by examiner

*Primary Examiner*—Huyen D Le
(74) *Attorney, Agent, or Firm*—Renner, Otto, Boisselle & Sklar, LLP

(57) ABSTRACT

A speaker diaphragm 1 includes a first diaphragm portion 5, a second diaphragm portion 6 integrally molded with the first diaphragm portion 5, and a bobbin-receiving portion 7 protruding from a back side of a connecting portion between the first diaphragm portion 5 and the second diaphragm portion 6, with one end of a voice coil bobbin 2 being bonded to the bobbin-receiving portion 7. The bobbin-receiving portion 7 includes a first extension 8 extending backwards from the first diaphragm portion 5 and a second extension 9 extending backwards from the second diaphragm portion 6. A bobbin-receiving groove 10 is defined between the first extension 8 and the second extension 9. The voice coil bobbin 2 is inserted in and bonded to the bobbin-receiving groove 10.

7 Claims, 6 Drawing Sheets

SPEAKER DIAPHRAGM AND SPEAKER USING THE SAME

BACKGROUND OF THE INVENTION

1. Field of the Invention

The present invention relates to a speaker diaphragm, and more particularly to a speaker diaphragm to which a voice coil bobbin can be attached with an improved bonding strength.

2. Description of the Related Art

FIG. 5 is a cross-sectional view showing a conventional speaker 500. The speaker 500 includes a bobbin 502, and a diaphragm 501 bonded to the outer surface of the bobbin 502. The outer surface of the bobbin 502 has a plain cylindrical shape (curved surface), and the adhesion between the bobbin 502 and the diaphragm 501 is dependent solely on the bonding strength of the adhesive used therebetween. Therefore, the vibration of the bobbin 502 cannot accurately be transmitted to the diaphragm 501 (some transmission loss occurs). The diaphragm 501 may come off the bobbin 502 due to deformation of the diaphragm 501 and/or an insufficient bonding strength. The vibration of the bobbin 502 produced according to an input signal is transmitted to the diaphragm 501 through a complicated path as indicated by arrows X1 to X4 in FIG. 5. Therefore, the vibration is reflected at the connecting portion between a dust cap 506 and the diaphragm 501, for example, thus increasing the transmission loss. A free end 502*a* of the bobbin 502 can act as an antinode of vibration and significantly bend and vibrate in the radial direction (the Y direction), resulting in unnecessary sound coming from the bobbin 502, thus deteriorating the S/N ratio.

The speaker of Patent Document 1 (Japanese Laid-Open Patent Publication No. 2002-125290) addresses the problem. FIG. 6 is a cross-sectional view showing an important part of a speaker 601 disclosed in Patent Document 1. In the speaker 601, a connecting portion 607 between a dome-shaped portion 605 and an edge portion 611 includes a bobbin-receiving groove 610 for receiving one end of a bobbin 602, which is bonded to the bobbin-receiving groove 610. The speaker 601 provides an improved bonding strength between a diaphragm 605 and the bobbin 602. However, the bobbin-receiving groove 610 is provided by forming a plurality of bends A1 to A7. The bends A1 to A7 significantly complicate the path through which the vibration of the bobbin 602 is transmitted to the dome-shaped portion 605 and the edge portion 611 via a horizontal portion 607*a* of the connecting portion 607. Thus, the vibration of the bobbin 602 is reflected at the bends A1 to A7, thus causing a transmission loss of vibration. Since the dome-shaped portion 605, the edge portion 611 and the connecting portion 607 are molded using the same material, the vibration of the bobbin 602 in the radial direction is transmitted to the dome-shaped portion 605 and the edge portion 611 via the connecting portion 607, resulting in distortion.

Patent Document 2 (Japanese Laid-Open Utility Model Publication No. 6-34397) discloses a speaker in which a reinforcement ring is provided at the distal end of the voice coil bobbin for increasing the bonding strength between the bobbin and the diaphragm. The outer periphery portion of the reinforcement ring forms an inclined surface that conforms with the surface of the diaphragm. The reinforcement ring is bonded to the bobbin and the diaphragm, and can improve the bonding strength between the bobbin and the diaphragm. However, the provision of the reinforcement ring adds to the number of components and the number of production steps. Moreover, the reinforcement ring has an adverse influence on the sound quality.

SUMMARY OF THE INVENTION

It is an object of the present invention to provide a speaker diaphragm with which it is possible to improve the bonding strength between the diaphragm and the voice coil bobbin, thereby reducing the transmission loss and improving the S/N ratio.

A speaker diaphragm according to a preferred embodiment of the present invention includes a first diaphragm portion, a second diaphragm portion integrally molded with the first diaphragm portion, and a bobbin-receiving portion protruding from a back side of a connecting portion between the first diaphragm portion and the second diaphragm portion, with one end of a voice coil bobbin being inserted in and attached (bonded) to the bobbin-receiving portion.

In a preferred embodiment, the bobbin-receiving portion includes a first extension extending backwards from the first diaphragm portion and a second extension extending backwards from the second diaphragm portion. A bobbin-receiving groove is defined between the first extension and the second extension, with the voice coil bobbin being inserted in and bonded to the bobbin-receiving groove.

Since one end of the voice coil bobbin is bonded to the bobbin-receiving portion, the end of the voice coil bobbin is fixed, whereby it is possible to prevent the end of the voice coil bobbin from vibrating in the radial direction. Therefore, it is possible to prevent the voice coil bobbin as a whole from vibrating (bending) in the radial direction, thereby preventing unnecessary sound from being generated from the voice coil bobbin itself. This can improve the S/N ratio. Moreover, this facilitates the positioning of the voice coil bobbin when attaching the voice coil bobbin to the diaphragm. Moreover, since the voice coil bobbin and the first diaphragm portion (and the second diaphragm portion) are firmly bonded to each other, it is possible to accurately transmit the vibration of the voice coil bobbin to the diaphragm and it is possible to prevent the diaphragm from being deformed. With the bobbin-receiving portion protruding from the back side of the diaphragm, it is no longer necessary to form a plurality of bends in the diaphragm as in Patent Document 1. Specifically, the first extension and the second extension are provided extending from the first diaphragm portion and the second diaphragm portion, respectively. Therefore, the first diaphragm portion and the second diaphragm portion have a very high durability. Moreover, the vibration of the voice coil bobbin is transmitted to the first diaphragm portion and the second diaphragm portion without being reflected. Therefore, it is possible to quite desirably prevent the transmission loss of vibration.

In a preferred embodiment, the first diaphragm portion and the second diaphragm portion are obtained by impregnating a substrate with a thermosetting resin. The bobbin-receiving portion is obtained as the thermosetting resin cures.

While the substrate is impregnated with the thermosetting resin to form the first diaphragm portion (and the second diaphragm portion), the bobbin-receiving portion can be formed by the same thermosetting resin. Thus, the production process is significantly simplified. Moreover, the bobbin-receiving portion, which is made only of the thermosetting resin, has a higher internal loss than that of the first diaphragm portion (and the second diaphragm portion), which are obtained by impregnating the substrate with the thermosetting resin. Therefore, the vibration of the voice coil bobbin in the radial direction is attenuated by the bobbin-receiving portion having a high internal loss and is less transmitted to the first diaphragm portion (and the second diaphragm portion). Thus, it is possible to prevent the generation of distortion.

In a preferred embodiment, the thermosetting resin is an unsaturated polyester resin.

An unsaturated polyester resin has a high cure rate and a low cure temperature, thus facilitating the production process, and it is possible with an unsaturated polyester to obtain the first and second diaphragm portions and the bobbin-receiving portion each having a desirable internal loss.

In another aspect of the present invention, there is provided a speaker including a speaker diaphragm as described above.

In still another aspect of the present invention, there is provided a method for producing a speaker diaphragm. The production method includes the steps of: impregnating portions of a substrate to be a first diaphragm portion and a second diaphragm portion with a thermosetting resin; supplying the thermosetting resin to a portion of a die for forming a bobbin-receiving portion to which one end of a voice coil bobbin is bonded; and curing the thermosetting resin, whereby a portion of the thermosetting resin with which the first diaphragm portion and the second diaphragm portion are impregnated forms the first diaphragm portion and the second diaphragm portion, while another portion of the thermosetting resin supplied to the portion of the die for forming the bobbin-receiving portion forms the bobbin-receiving portion. Thus, the production process is significantly simplified.

DETAILED DESCRIPTION OF THE PREFERRED EMBODIMENTS

Figure 1:
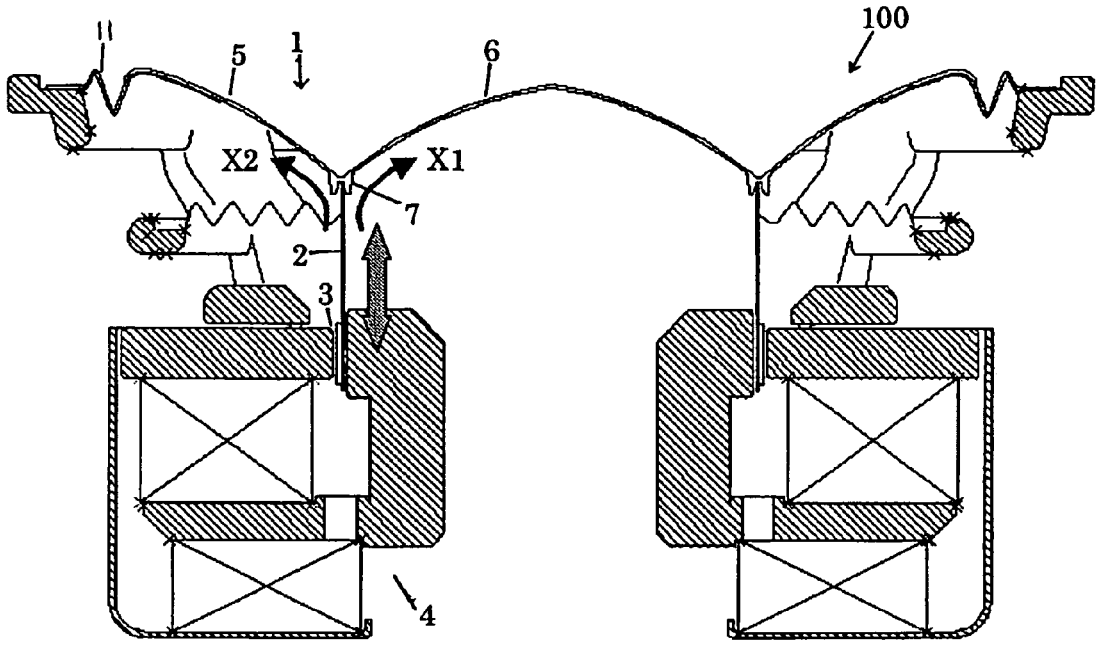
FIG. 1 is a schematic cross-sectional view showing a speaker according to a preferred embodiment of the present invention.
Figure 2:
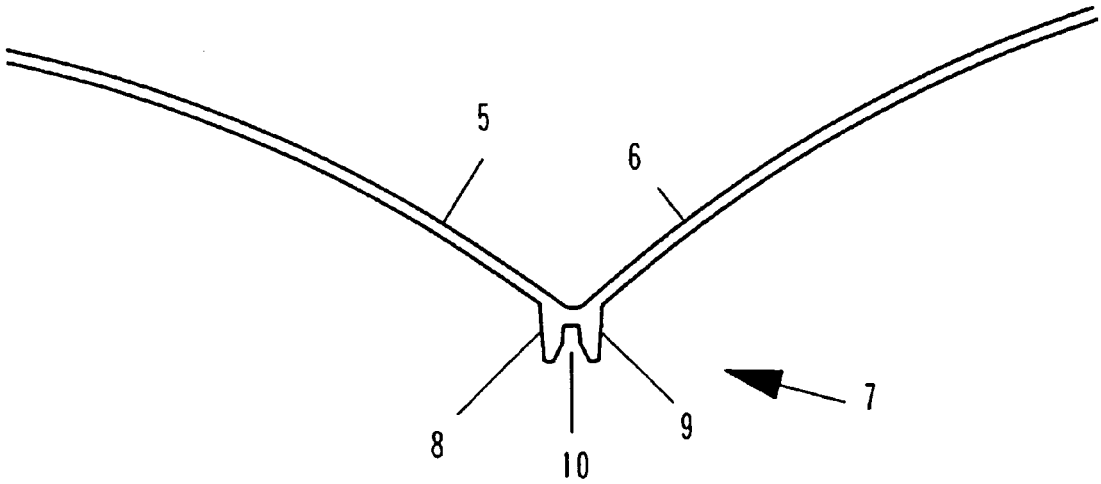
FIG. 2 is a schematic cross-sectional view showing an important part of the speaker diaphragm shown in FIG. 1.

While a preferred embodiment of the present invention will now be described with reference to the drawings, it is understood that the present invention is not limited thereto. FIG. 1 is a schematic cross-sectional view showing a speaker 100 according to a preferred embodiment of the present invention. FIG. 2 is an enlarged view showing an important part of a diaphragm 1 of the speaker 100. The speaker 100 includes the diaphragm 1, a voice coil bobbin 2 bonded to the diaphragm 1, and a voice coil 3 wound around a lower portion of the voice coil bobbin 2. The voice coil 3 is placed in the magnetic gap of a magnetic circuit 4, and is displaced in the magnetic gap according to the input signal to drive the diaphragm 1.

The diaphragm 1 includes a first diaphragm portion 5, and a second diaphragm portion 6 integrally molded with the first diaphragm portion 5. As necessary, the diaphragm 1 includes an edge portion 11 integrally molded with the first diaphragm portion 5 (the edge portion 11 does not have to be integrally molded with the first diaphragm portion 5). The first diaphragm portion 5 is a cone-shaped diaphragm, and forms an outer periphery portion of the diaphragm 1. The second diaphragm portion 6 is a dome-shaped diaphragm (which may also function as a dust cap), and forms an inner periphery portion of the diaphragm 1. Since the first diaphragm portion 5 and the second diaphragm portion 6 are integrally molded with each other, the vibration of the voice coil bobbin 2 can be transmitted more smoothly (without being reflected) through the connecting portion between the first diaphragm portion 5 and the second diaphragm portion 6, thus preventing the transmission loss. The diaphragm 1 also includes a bobbin-receiving portion 7 for receiving the voice coil bobbin 2, which is bonded to the bobbin-receiving portion 7 with an adhesive. The bobbin-receiving portion 7 extends in a circular pattern while protruding from the back side of the diaphragm 1 (more specifically, the connecting portion between the first diaphragm portion 5 and the second diaphragm portion 6). The back surface of the diaphragm 1 as used herein refers to the side of the diaphragm 1 on which the voice coil bobbin 2 is bonded. The connecting portion as used herein refers to a portion of the diaphragm 1 at the boundary between the first diaphragm portion 5 and the second diaphragm portion 6, including the vicinity thereof. In other words, the connecting portion is the trough between two rising surfaces (i.e., the first diaphragm portion 5 and the second diaphragm portion 6), including the vicinity thereof. Since the bobbin-receiving portion 7 is protruding from the back side, but not from the front side, of the diaphragm 1, there is no need to form any bends in the first diaphragm portion 5 or the second diaphragm portion 6 for forming the bobbin-receiving portion 7. Since no portion of the bobbin-receiving portion 7 is exposed on the front side of the diaphragm 1, the surface of the diaphragm 1 looks very beautiful.

The bobbin-receiving portion 7 is integrally molded with the first diaphragm portion 5 and the second diaphragm portion 6. This simplifies the production process and also prevents the bobbin-receiving portion 7 from coming off the first diaphragm portion 5 and the second diaphragm portion 6. The bobbin-receiving portion 7 includes a first extension 8 extending backwards from the first diaphragm portion 5 and a second extension 9 extending backwards from the second diaphragm portion 6, thus defining a bobbin-receiving groove 10 between the first extension 8 and the second extension 9. The first extension 8 and the second extension 9 (i.e., the bobbin-receiving groove 10 therebetween) extend in a circular pattern on the back side of the diaphragm 1. The thickness of each of the first extension 8 and the second extension 9 is preferably 0.5 mm to 20 mm. A thickness less than 0.5 mm will result in an insufficient bonding strength, and a thickness greater than 20 mm will excessively add to the weight of the connecting portion between the first diaphragm portion 5 and the second diaphragm portion 6 to lower the acoustic pressure. One end of the voice coil bobbin 2 is inserted into the bobbin-receiving groove 10 of the bobbin-receiving portion 7, and is bonded to the bobbin-receiving portion 7 while being sandwiched between the first and second extensions 8 and 9. Since the end of the voice coil bobbin 2 is in contact with the first diaphragm portion 5 and the second diaphragm portion 6, the vibration of the voice coil bobbin 2 is transmitted to the first diaphragm portion 5 and the second diaphragm portion 6 directly (not through the first and second extensions 8 and 9). Moreover, no bend portions are formed in the first diaphragm portion 5 and the second diaphragm portion 6 as described above, and thus there is no surface that reflects the vibration. Therefore, the vibration of the voice coil bobbin 2 is transmitted, without being reflected, across the first diaphragm portion 5 and the second diaphragm portion 6 as indicated by arrows X1 and X2 in FIG. 1.

The first diaphragm portion 5 and the second diaphragm portion 6 are obtained by impregnating a substrate with a thermosetting resin. While the thermosetting resin may be any suitable thermosetting resin, it is preferably an unsaturated polyester. An unsaturated polyester is preferred because it has a high cure rate and a low cure temperature, thus facilitating the production process, and it is possible with an unsaturated polyester to obtain the first diaphragm portion 5 and the second diaphragm portion 6 with a desirable internal loss.

Any suitable woven or non-woven fabric may be selected for the substrate depending on the intended application and purpose. It may be a single woven or non-woven fabric, a laminate of a plurality of non-woven fabrics, or a laminate of a woven fabric and a non-woven fabric. Typical materials for the non-woven fabric include para-aramid fibers, meta-aramid fibers, rayon fibers, cotton fibers, ultra high strength polyethylene fibers, and polyarylate fibers. Typical materials for the woven fabric include poly(trimethylene terephthalate) and polyethylene naphthalate (PEN).

The bobbin-receiving portion 7 (the first extension 8 and the second extension 9) is molded using a resin. Preferably, the bobbin-receiving portion 7 is obtained as the thermosetting resin, which is also used for the first diaphragm portion 5 and the second diaphragm portion 6, cures. In other words, the bobbin-receiving portion 7 is preferably obtained by molding an unsaturated polyester. An unsaturated polyester is preferred because it has a high cure rate and a low cure temperature, thus facilitating the production process, and it is possible with an unsaturated polyester to obtain the bobbin-receiving portion 7 with a desirable internal loss. As will be later described in greater detail, when the substrate of the first diaphragm portion 5 and the second diaphragm portion 6 is impregnated with a thermosetting resin, the thermosetting resin drips into a portion of a die that corresponds to the bobbin-receiving portion 7, which cures to form the bobbin-receiving portion 7. Thus, the production process is significantly simplified. The bobbin-receiving portion 7, which is made only of the thermosetting resin, has a higher internal loss than that of the first diaphragm portion 5 and the second diaphragm portion 6, which are obtained by impregnating the substrate with the thermosetting resin. For example, in a case where a PEN fiber material is used for the substrate and an unsaturated polyester is used as the thermosetting resin, the internal loss ratio between the bobbin-receiving portion 7 and the first diaphragm portion 5 (and the second diaphragm portion 6) is 3:1 to 1.2:1 (the internal loss of the bobbin-receiving portion 7 is 0.3 to 0.6, and the internal loss of the first diaphragm portion 5 and the second diaphragm portion 6 is 0.1 to 0.5). Therefore, the vibration of the voice coil bobbin 2 in the radial direction is attenuated by the bobbin-receiving portion 7 having a high internal loss and is not transmitted to the first diaphragm portion 5 and the second diaphragm portion 6. Therefore, it is possible to prevent the generation of distortion or noise due to the vibration of the voice coil bobbin 2 in the radial direction, thereby improving the S/N ratio.

Figure 3:
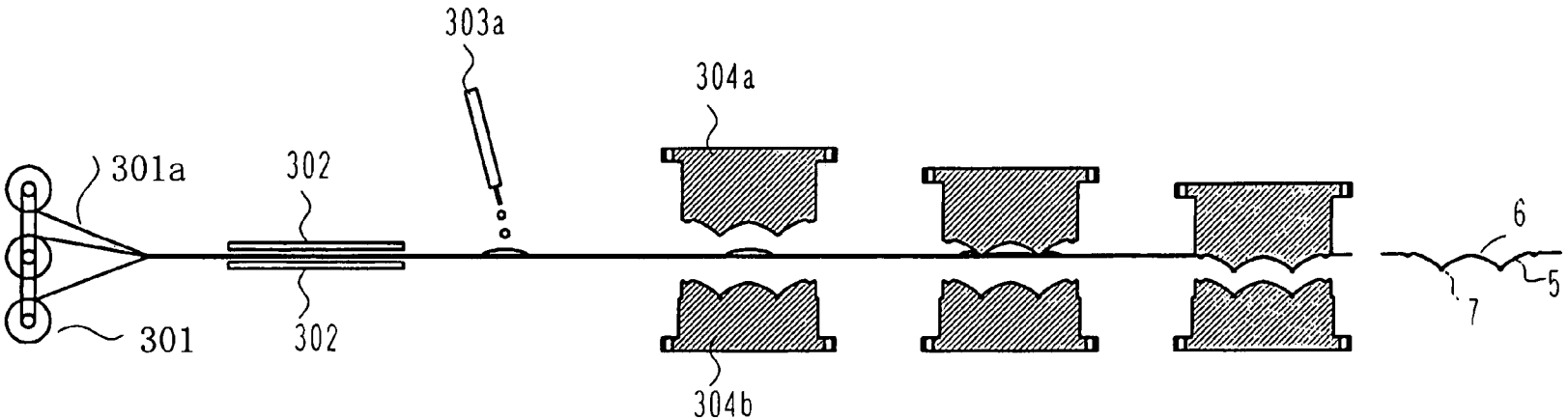
FIG. 3 shows a method for producing the speaker diaphragm shown in FIG. 1.

A method for producing the speaker diaphragm 1 will now be described with reference to FIG. 3. A substrate 301*a* is provided in a feeder 301 in the form of rolls, and is fed forward from the feeder 301 during the production process. In order to prevent the deformation during the molding process, both sides of the substrate 301*a* with respect to the feeding direction are movably supported by a clamp 302.

Then, a thermosetting resin is selectively dispensed from a resin dispenser nozzle 303*a* onto the first diaphragm portion 5 and the second diaphragm portion 6 of the substrate 301*a*.

Figure 4:
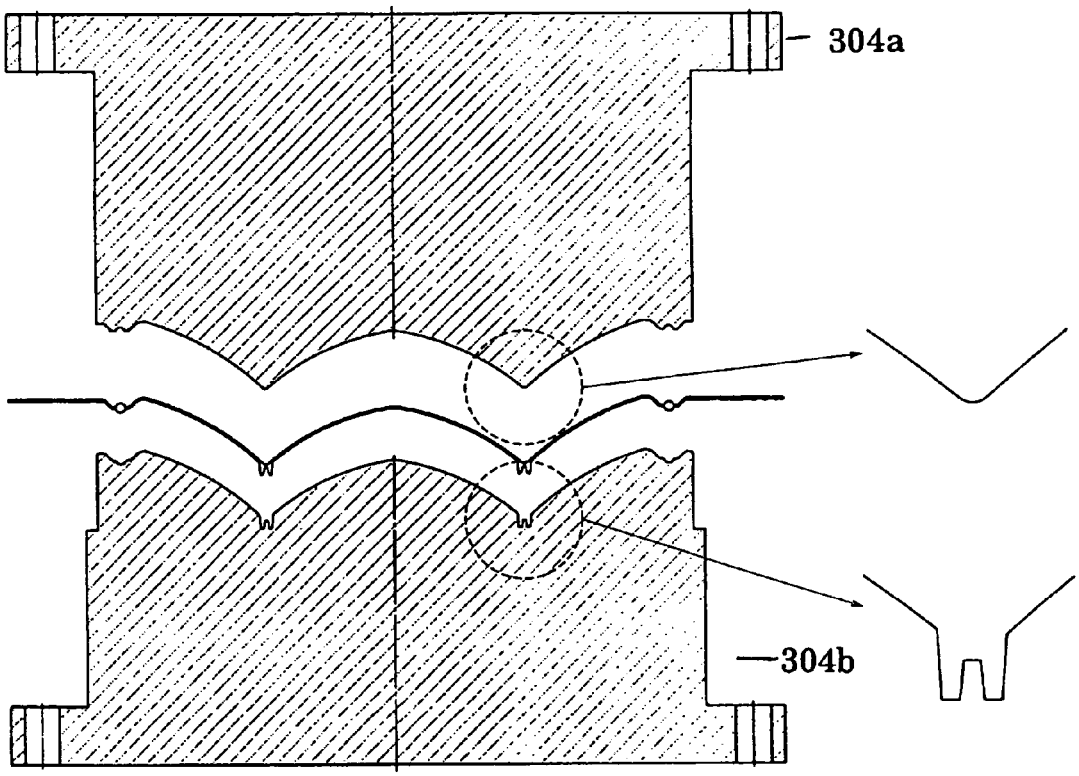
FIG. 4 shows dies used in the production method shown in FIG. 3.
Figure 5:
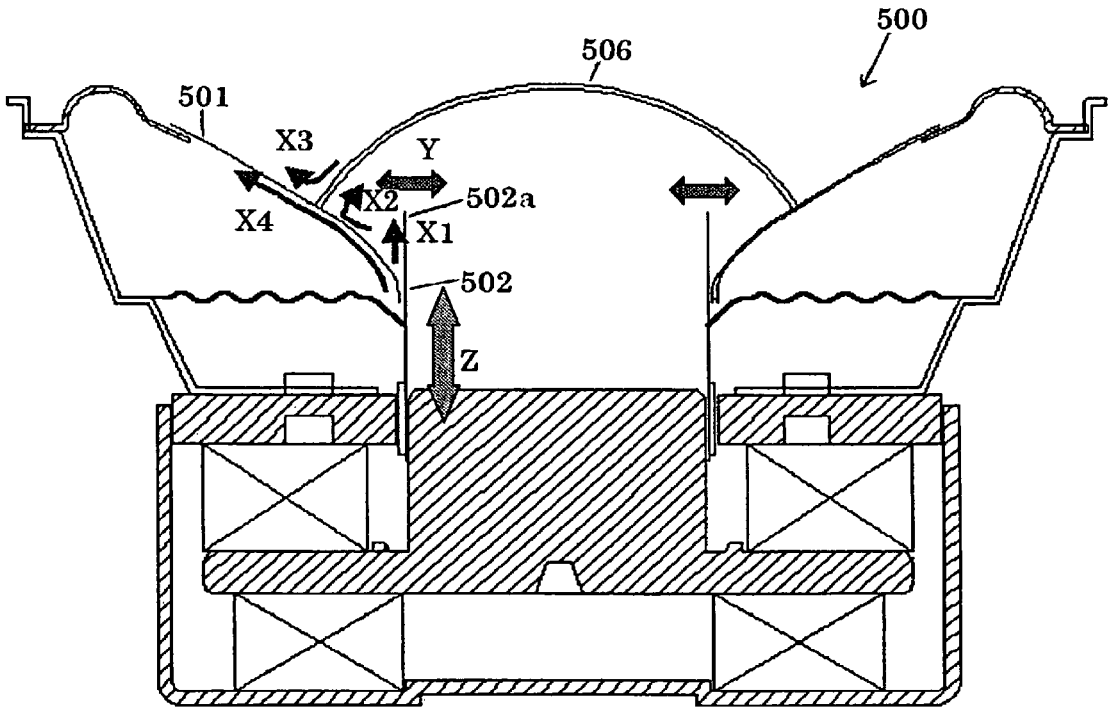
Fig. 5 (Prior Art)
FIG. 5 is a schematic cross-sectional view showing a conventional speaker.
Figure 6:
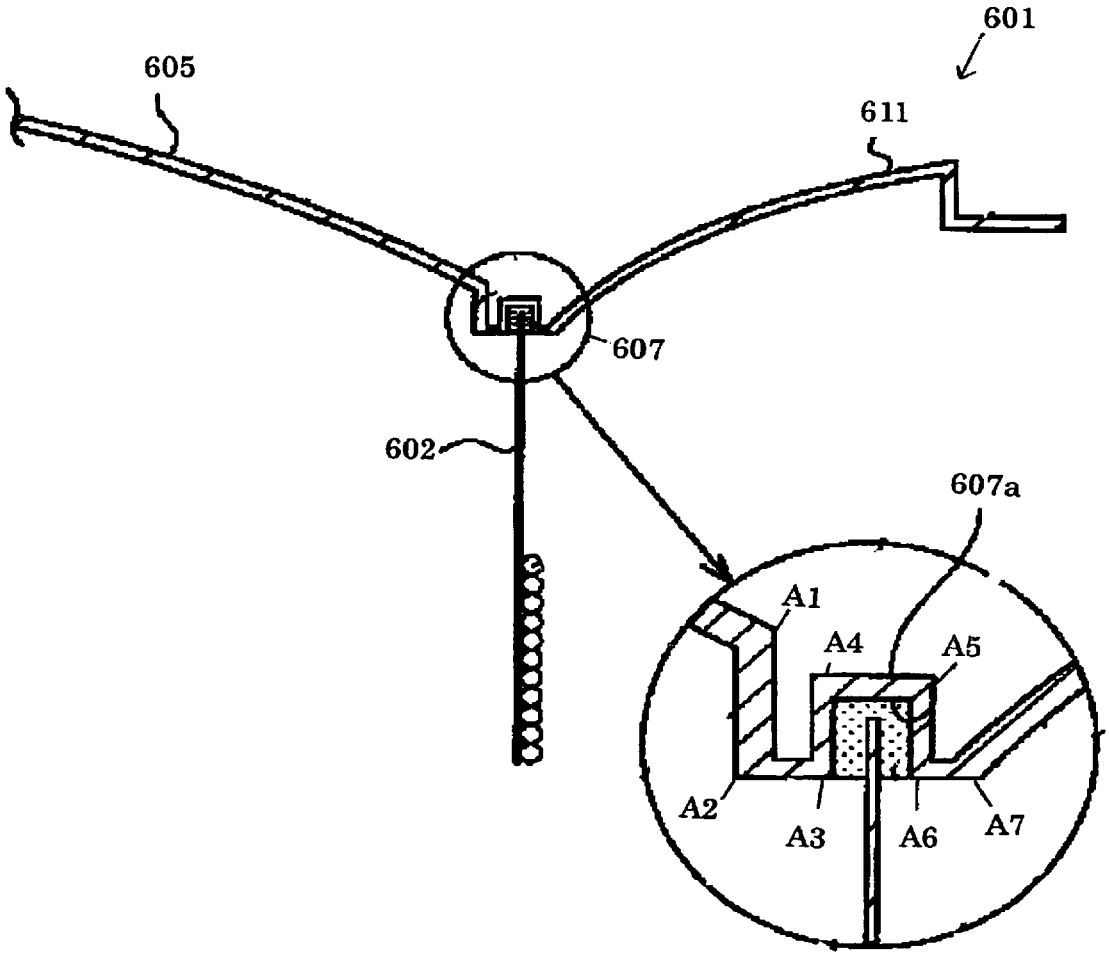
Fig. 6 (Prior Art)
FIG. 6 is a schematic cross-sectional view showing a conventional speaker.

Then, the substrate 301*a* with the thermosetting resin thereon is heat-pressed using an upper die 304*a* and a lower die 304*b* defining the shape of the diaphragm 1 therebetween. FIG. 4 is a schematic cross-sectional view showing the upper die 304*a* and the lower die 304*b*. The upper die 304*a* defines the shape of the upper surface of the diaphragm 1 (the first diaphragm portion 5 and the second diaphragm portion 6), and the lower die 304*b* defines the shape of the back surface of the diaphragm 1 (the first diaphragm portion 5, the second diaphragm portion 6 and the bobbin-receiving portion 7). As a result of the heat-pressing, the thermosetting resin permeates the first diaphragm portion 5 and the second diaphragm portion 6 of the substrate 301*a* and cures to form the first diaphragm portion 5 and the second diaphragm portion 6, while a portion of the thermosetting resin supplied to a portion of the lower die 304*b* that defines the shape of the bobbin-receiving portion 7 also cures to form the bobbin-receiving portion 7. Since only the lower die 304*b* has the portion defining the shape of the bobbin-receiving portion 7, the bobbin-receiving portion 7 is formed on the back side of the diaphragm 1. Finally, the obtained product is released from the dies and the peripheral portion is trimmed to obtain the diaphragm 1.

Note that the heat-pressing conditions (e.g., the die temperature, the pressing pressure, the pressing time and the die clearance) are appropriately determined according to the intended purpose or the kind of a non-woven fabric substrate to be used. Typically, the die temperature is 100° C. to 130° C., the heating time is 0.5 to 3 minutes, the pressing pressure is 15 to 25 kg/cm$^2$, and the die clearance (corresponding to the thickness of the speaker part to be obtained) is 0.1 to 0.3 mm.

While an example of the present invention will now be described, it is understood that the present invention is not limited thereto. The part and percentage designations used in the following example are by weight unless otherwise specified.

An unsaturated polyester solution was prepared with the following composition:

100 parts of an unsaturated polyester resin (N350L from Nippon Shokubai Co., Ltd.);

5 parts of a low profile agent (MODIPER S501 from NOF Corporation); and 1.3 parts of PEROCTA O (from NOF Corporation).

The substrate was obtained by layering together a front layer and a back layer. The front layer was a woven fabric prepared from a plain fabric of a non-twisted polyethylene naphthalate (PEN) fiber (from Teijin Limited, yarn count: 1100×1100 (dtex), density: 17×17 (yarns/inch), weight: 166 g/m$^2$), which was impregnated with 5 parts of a melamine resin and then dried. The back layer was a 15-cm$^2$ cut piece of a TECHNORA non-woven fabric (from Teijin Limited, weight: 60 g/m$^2$). A jig obtained by making a circular hole having a diameter of about 16 cm at the center of a stainless steel plate having a size of about 20 cm$^2$ was used as a clamp. The substrate was sandwiched between a pair of such clamps, and the prepared unsaturated polyester solution (about 5 g) was dripped around the center of the clamped substrate. Then, the substrate was molded between matched dies defining the shape of a diaphragm as shown in FIG. 4 at 130° C. for 30 seconds to obtain a diaphragm having a diameter of 16 cm and a thickness of 0.35 mm. Only the lower die has a cut groove defining the shape of the bobbin-receiving portion 7, and the unsaturated polyester resin cures therein to form the bobbin-receiving portion 7 only on the back side of the diaphragm 1.

The Young's modulus and the internal loss of the bobbin-receiving portion 7 and those of the first diaphragm portion 5 (the second diaphragm portion 6) of the obtained diaphragm were measured by an ordinary method. Table 1 below shows the results.

TABLE 1

| | Young's modulus (dyne/cm$^2$) | Internal loss (tanδ) |
|---|---|---|
| Bobbin-receiving portion 7 | $1.2 \times 10^9$ | 0.45 |
| First diaphragm portion 5 | $4.5 \times 10^{10}$ | 0.2 |

As shown in Table 1, the internal loss of the bobbin-receiving portion 7 is 2.25 times that of the first diaphragm portion 5 (and the second diaphragm portion 6). Therefore, the vibration of the voice coil bobbin 2 in the radial direction is attenuated by the bobbin-receiving portion 7 having a high internal loss and is less transmitted to the first diaphragm portion 5 (and the second diaphragm portion 6). Thus, it is possible to prevent the generation of distortion. While a preferred embodiment of the present invention and an example thereof have been described above, it is understood that the present invention is not limited thereto.

The speaker diaphragm of the present invention can suitably be used in speakers of various applications (those for household use, those used on vehicles, etc.). Moreover, the present invention can be used with various types of speakers, irrespective of their characteristics, such as woofers for reproducing low-frequency ranges or tweeters for reproducing high-frequency ranges.

The speaker diaphragm of the present invention includes a bobbin-receiving portion protruding from the back side of a connecting portion between a first diaphragm portion and a second diaphragm portion of the diaphragm, and one end of a voice coil bobbin is bonded to the bobbin-receiving portion. Thus, the voice coil bobbin and the diaphragm can be firmly bonded together while improving the S/N ratio.

What is claimed is:

1. A speaker diaphragm, comprising a first diaphragm portion, a second diaphragm portion integrally molded with the first diaphragm portion, and a bobbin-receiving portion protruding from a back side of a connecting portion between the first diaphragm portion and the second diaphragm portion, with one end of a voice coil bobbin being inserted in and attached to the bobbin-receiving portion, wherein the first diaphragm portion and the second diaphragm portion are obtained by impregnating a substrate with a thermosetting resin, and the bobbin-receiving portion is obtained as the thermosetting resin cures so that the bobbin-receiving portion is made only of the thermosetting resin.

2. The speaker diaphragm according to claim 1, wherein the bobbin-receiving portion includes a first extension extending backwards from the first diaphragm portion and a second extension extending backwards from the second diaphragm portion, thereby defining a bobbin-receiving groove between the first extension and the second extension, with the voice coil bobbin being inserted in and bonded to the bobbin-receiving groove.

3. The speaker diaphragm according to claim 1, wherein the thermosetting resin is an unsaturated polyester resin.

4. The speaker diaphragm according to claim 3, wherein a material of the substrate is a polyethylene naphthalate fiber.

5. The speaker diaphragm according to claim 1, wherein an internal loss ratio between the bobbin-receiving portion and the first diaphragm portion is 3:1 to 1.2:1.

6. A speaker, comprising a speaker diaphragm including a first diaphragm portion, a second diaphragm portion integrally molded with the first diaphragm portion, and a bobbin-receiving portion protruding from a back side of a connecting portion between the first diaphragm portion and the second diaphragm portion, with one end of a voice coil bobbin being inserted in and attached to the bobbin-receiving portion, wherein the first diaphragm portion and the second diaphragm portion are obtained by impregnating a substrate with a thermosetting resin, and the bobbin-receiving portion is obtained as the thermosetting resin cures so that the bobbin-receiving portion is made only of the thermosetting resin.

7. A method for producing a speaker diaphragm, comprising the steps of:

impregnating portions of a substrate to be a first diaphragm portion and a second diaphragm portion with a thermosetting resin;

supplying the thermosetting resin to a portion of a die for forming a bobbin-receiving portion to which one end of a voice coil bobbin is bonded; and curing the thermosetting resin, whereby a portion of the thermosetting resin with which the first diaphragm portion and the second diaphragm portion are impregnated forms the first diaphragm portion and the second diaphragm portion, while another portion of the thermosetting resin supplied to the portion of the die for forming the bobbin-receiving portion forms the bobbin-receiving portion so that the bobbin-receiving portion is made only of the thermosetting resin.

* * * * *